US009500146B2

(12) United States Patent
Eriksson

(10) Patent No.: US 9,500,146 B2
(45) Date of Patent: Nov. 22, 2016

(54) METHOD AND APPARATUS FOR CONTROLLING AN ENGINE TO ACHIEVE A BOOSTED PERFORMANCE FOR A LIMITED TIME

(75) Inventor: Johnny Eriksson, Onsala (SE)

(73) Assignee: Volvo Lastvagnar AB, Göteborg (SE)

( * ) Notice: Subject to any disclaimer, the term of this patent is extended or adjusted under 35 U.S.C. 154(b) by 416 days.

(21) Appl. No.: 14/240,780

(22) PCT Filed: Aug. 29, 2011

(86) PCT No.: PCT/EP2011/004315

§ 371 (c)(1),
(2), (4) Date: Feb. 25, 2014

(87) PCT Pub. No.: WO2013/029636

PCT Pub. Date: Mar. 7, 2013

(65) Prior Publication Data

US 2014/0214305 A1 Jul. 31, 2014

(51) Int. Cl.
*F02D 41/00* (2006.01)
*F02D 31/00* (2006.01)
(Continued)

(52) U.S. Cl.
CPC ..... *F02D 31/001* (2013.01); *F02D 11/105* (2013.01); *F02D 41/021* (2013.01); *F02D 2250/26* (2013.01)

(58) Field of Classification Search
CPC ..... F02D 33/006; F02D 41/045; F02D 2041/1433
USPC ..... 123/357, 478–490; 701/101, 102, 114, 701/115
See application file for complete search history.

(56) References Cited

U.S. PATENT DOCUMENTS 5,268,842 A * 12/1993 Marston ..... F02D 41/2445 123/480
5,394,136 A * 2/1995 Lammers ..... G07C 5/008 340/438

(Continued)

FOREIGN PATENT DOCUMENTS

AU 2005222519 A1 11/2005
EP 0770773 A2 5/1997
EP 1239133 A2 9/2002

OTHER PUBLICATIONS

International Search Report (May 7, 2012) for corresponding International application No. PCT/EP2011/004315.

(Continued)

*Primary Examiner* — Thomas Moulis
(74) *Attorney, Agent, or Firm* — WRB-IP LLP

(57) ABSTRACT

A method is provided for controlling an engine to allow a driver to obtain a working range of the engine in excess a base working range thereof The method includes establishing a base working range, which limits are defined by a base torque versus engine speed curve, establishing an excess working range, which limits are defined between the base torque versus engine speed curve and an excess torque versus engine speed curve, the excess torque versus engine speed curve displaying a higher maximum torque level and/or a higher end engine speed as compared to the base torque versus engine speed curve, establishing an excess availability limit, defining the maximum duration or maximum distance of access to the excess working range per unit time or unit distance, calculating a cumulative consumed excess value per unit time or unit distance by summating any time periods or distances during which the excess working range is accessed within the unit time or unit distance, and controlling the engine in response to driver input to allow access to the excess working range only when the cumulative consumed excess value is less than the excess availability limit.

17 Claims, 6 Drawing Sheets

(51) Int. Cl.
*F02D 11/10* (2006.01)
*F02D 41/02* (2006.01)

(56) References Cited

U.S. PATENT DOCUMENTS 5,740,044 A * 4/1998 Ehrenhardt ..... F02D 31/009 318/434
5,954,617 A * 9/1999 Horgan ..... B60K 31/047 123/349
6,347,272 B2 * 2/2002 Flammersfeld ..... B60K 21/042 180/178
6,601,442 B1 * 8/2003 Decker ..... F02D 41/2451 701/114
7,512,477 B2 * 3/2009 Quigley ..... F02D 41/1406 701/103
8,175,780 B2 * 5/2012 Quinn ..... B60W 10/06 318/432
8,970,360 B2 * 3/2015 Fujiki ..... G01D 7/00 340/425.5
9,221,452 B2 * 12/2015 Tang ..... B60W 10/06
2001/0044690 A1 11/2001 Flammersfeld et al.
2008/0243353 A1 * 10/2008 Hollenbeck ..... B60W 50/038 701/102
2011/0166731 A1 * 7/2011 Kristinsson ..... B60W 10/08 701/22

OTHER PUBLICATIONS

International Preliminary Report on Patentability (Aug. 27, 2013) for corresponding International application No. PCT/EP2011/004315.

* cited by examiner

METHOD AND APPARATUS FOR CONTROLLING AN ENGINE TO ACHIEVE A BOOSTED PERFORMANCE FOR A LIMITED TIME

BACKGROUND AND SUMMARY

This application relates to a method for controlling an engine to allow a driver to obtain a working range of the engine in excess of a base working range thereof. In another aspect, the application relates to a system for controlling an engine to allow a driver to obtain a working range of the engine in excess of a base working range thereof. The engine is preferably an engine for a heavy vehicle, such as a lorry or truck.

Fuel economy is an increasingly important subject to the world's fleets of heavy vehicles, motivated both by economy and by environmental concerns. In order to delimit the fuel consumption during transports with heavy vehicles, it has been suggested to control the driving patterns of the drivers of the vehicles.

For example, it is common practice to set a maximum road speed limit (RSL) for a fleet of vehicles, which maximum road speed limit cannot be exceeded by the driver of the vehicle. Generally, only the manager of the vehicle fleet or the owner of a single vehicle may access the control so as to set said road speed limit.

However, in certain driving situations, it may be a disadvantage to be limited to the maximum road speed limit, such as during an overtaking or passing of another vehicle.

In US 2001 0044690, a system and method for controlling an engine in a vehicle is proposed, which allows the vehicle operator to manually request a vehicle speed in excess of the established vehicle speed limit. This method includes setting a normal vehicle speed limit, setting a passing duration period, setting a passing override reset interval, and controlling the engine in response to operator input to provide a greater vehicle speed for a cumulative period not greater than the passing duration period at any time during the passing override reset interval.

It is desirable to find an alternative solution for controlling the driving patterns of the vehicle so as to, at least to some extent, meet the requirements of fuel economy and of vehicle versatility when driving.

According to an aspect of the present invention, a method is provided for controlling an engine to allow a driver to obtain a working range of the engine in excess a base working range thereof, the method comprising establishing a base working range, which limits are defined by a base torque versus engine speed curve, establishing an excess working range, which limits are defined between said base torque versus engine speed curve and an excess torque versus engine speed curve, the excess torque versus engine speed curve displaying a higher maximum torque level and/or a higher end engine speed as compared to the base torque versus engine speed curve, establishing an excess availability limit, defining the maximum duration or maximum distance of access to the excess working range per unit time or unit distance, calculating a cumulative consumed excess value per unit time or unit distance by summating any time periods or distances during which the excess working range is accessed within the unit time or unit distance; and controlling the engine in response to driver input to allow access to the excess working range only when the cumulative consumed excess value is less than the excess availability limit.

In accordance with the invention, the engine control method with the purpose to improve and reduce fuel consumption is not based only on controlling the vehicle speed. Instead, the torque versus engine speed curve of the engine of the vehicle is considered.

In an engine, the available torque is defined by a torque versus engine speed curve (See FIG. 1).

In FIG. 1, an example of a torque versus engine speed curve is depicted, which displays an approximately constant maximum torque over a relatively wide range of engine speeds. Thereafter, the torque curve slopes downwards towards higher engine speeds, indicating a lower available maximum torque at higher engine speeds. Finally, the torque declines to zero torque, where the engine speed corresponding to zero torque corresponds to the end engine speed.

It shall be understood that many different variants of torque versus engine speed curves are possible, the shapes varying for different engines. The example curves of the figures are hence to be seen as non-limiting examples only.

The term "end engine speed" as used herein is sometimes referred to with the term "end governed engine speed", and is defined as the engine speed corresponding to zero torque.

In accordance with the invention, there is established a base torque versus engine speed curve. The area below the base torque versus engine speed curve illustrates the base working range within which the engine is intended to work, and may be set by logics in the engine control system to a level dimensioned to improve fuel consumption while still enabling the engine function to perform adequately considering the loads involved.

In addition to the base torque versus engine speed curve, an excess torque versus engine speed curve is defined. This curve will have a higher maximum torque and/or a higher end engine speed than the base curve (See FIG. 2). An excess working range of the engine is defined between the excess torque versus engine speed curve and the base torque versus engine speed curve. Accordingly, each engine speed value in the excess working range corresponds to the same or a higher torque value than on the base torque versus engine speed curve.

Again, various shapes of the base torque versus engine speed curve as well as the excess torque versus engine speed curve are possible, giving rise to different areas forming the excess working range. The invention is not restricted to the shapes of the examples in FIGS. 1 and 2.

In accordance with the invention, torque and engine speed are controlled rather than the speed of the vehicle hosting the engine, which vehicle speed is controlled in many prior art methods. Controlling torque and sometimes allowing excess torque has the advantage that the torque may not only be used to obtain a higher vehicle speed (even if this is of course possible). Instead, the excess torque could be used for example to enable the driver to maintain vehicle speed when driving uphill.

When the excess torque versus engine speed curve displays a higher end engine speed, this means that it is possible to maintain torque at a higher engine speed as compared to the base torque versus engine speed. This is sometimes referred to as having a "longer" engine, with which it possible to stay more often with a lower gear, which also may increase the comfort for the driver when driving.

Also, the control of the torque versus engine speed curve may be combined with controlling power, e.g. to allow excess power during similar circumstances as those explained below. This enables access to excess performance level (torque and power) of the engine.

In accordance with the invention, access to the excess working range of the engine is restricted. The basic idea is that the excess working range should only be available a fraction of the time used for driving, or expressed differently, a fraction of the distance travelled when driving. Time and distance are both suitable parameters for controlling the availability of the excess working range.

Hence, it is suggested to establish an excess availability limit, which may be seen as a buffer including a certain amount of access to the excess working range per unit time or distance.

Moreover, it is suggested to regularly or continuously calculate a cumulative consumed excess value per unit time or distance. The cumulative consumed excess value will indicate the amount of access to the excess working range which has already been used within the unit time or distance.'

Access to the excess working range will be allowed only when the cumulative consumed excess value is less than the excess availability limit, in other words when the used amount of access to the excess working range is less than the buffer amount—the excess availability limit.

When time is used as a parameter, the excess availability limit will be the maximum duration of access to the excess working range per unit time. For example, the excess availability limit could be 5 minutes per hour (5 min/60 min).

During, driving, it in this case is suggested to calculate a cumulative consumed excess value per unit time by summating any time periods during which the excess working range is accessed within the unit time. For example, if the driver accesses the excess working range for 1 minute, then for 2.5 min, and then for 0.5 min within an hour, the cumulative consumed excess value at the end of that hour would be 1+2.5+0.5=4 min.

The engine is to be controlled in response to driver input to allow access to the excess working range only when the cumulative consumed excess value is less than the excess availability limit. Accordingly, in the example above, the cumulative consumed excess value of 4 min is less than the excess availability limit of 5 min, meaning that new access to the excess working range should be allowed for another 1 min during this static time limitation of 1 hour.

Alternatively, the excess availability limit may be defined using distance, as the maximum distance of access to the excess working range per unit time. For example, the excess availability limit could be 8 km/100 km.

In this case, the cumulative consumed excess value may be calculated per unit distance by summating any distances during which the excess working range is accessed within the unit distance. For example, if the driver accesses the excess working range for 2 km, then for 3 km, and then for 1 min within a drive of 100 km, the cumulative consumed excess value at the end of those 100 km would be 2+3+1=6 km.

The engine is to be controlled in response to driver input to allow access to the excess working range only when the cumulative consumed excess value is less than the excess availability limit. Accordingly, in the example above, the cumulative consumed excess value of 6 km is less than the excess availability limit of 8 km, meaning that new access to the excess working range should be allowed.

Moreover, the availability of the excess working range could be controlled using both time and distance as parameters. For example, limits could be set for both time and distance, whereafter a minimum choice calculation of the two could be used to control availability.

In one embodiment of the invention, the excess availability limit is a constant, preset maximum excess availability limit. For example, the excess availability limit may be 5 minutes or 8 km, the value being constant while driving.

In another embodiment however, the excess availability limit may be a dynamic value, meaning that the value may alter e.g. during a drive. One preferred example of a method using a dynamic excess availability limit is a method using a leaky bucket" counter to calculate the excess availability limit. In this case, e.g. any time period of driving without using the excess working range adds time to the excess availability limit (fills the bucket), but only to a preset, maximum excess availability limit. Any time period of driving while using the excess working range will not add time to the excess availability limit.

Alternatively, the bucket may be filled (time may be added to the excess availability limit) also during time where the excess working range is used. The periods of use of the excess working range are generally very short in relation to the periods without the excess working range, meaning that their contribution to the excess availability limit is not crucial for the final excess availability limit.

For example, it could be determined that for every 10 minutes of driving without using the excess working range, the excess availability limit is added to with one minute. After 50 minutes of driving without using the excess working range, the excess availability limit is up to 5 minutes, being the maximum excess availability limit. Continued driving without using the excess working range will not increase the excess availability limit.

At this point, the driver may use all of the 5 minutes, that is the driver could access the excess working range for a full 5 minutes, if desired. If so, the excess availability limits drops to 0, and the driver must driver for 50 minutes without using the excess range in order to refill the excess availability limit completely. If instead only 1 minute of driving in the excess working range is perfumed, the excess availability limit drops to 4 minutes, and the driver must drive another 10 min without the excess range, in order to obtain the maximum excess availability limit.

A dynamic excess availability limit, of the type exemplified above or of another design, could be advantageous since it may be used to encourage the driver to "save" excess working range.

Generally, the "filling" of the bucket should take place relatively slowly, i.e. the fill time is a fraction of the actual driving time during which the bucket is filled.

The above applies mutatis mutandis when the excess availability limit is expressed as maximum distance of access per unit distance instead of in maximum duration per unit time.

When a drive is finalized, the excess availability limit at the end of the drive may be stored. The excess availability limit may be stored in a memory in the vehicle control system, so as to be available when the same vehicle is used again. Alternatively, the excess availability limit may be saved as personalized information, e.g. on a Driver Card, belonging to the driver, and hence he accessible to the driver at his/her next drive, also if another vehicle is used.

In an embodiment of the invention a method is proposed wherein, for each unit time or unit distance, the cumulative consumed excess value is set to zero at the start of the unit time or unit distance, and the cumulative consumed excess value per unit time or unit distance is calculated at any time or distance by summating the time periods or distances during which the excess working range is accessed during the unit time or distance.

For example, if a driver accesses the excess range for 1 minute, then for 2.5 min, and then for 0.5 min within an hour, the cumulative consumed excess value at the end of that hour would be 1+2.5+0.5=4 min. However, as the first hour expires, the cumulative consumed excess value is reset to zero, and the calculation restarts for the second hour of driving. (The case will be similar if distance is used instead of time.)

Alternatively, a method is proposed wherein the cumulative consumed excess value per unit time or unit distance is calculated at any time or distance by summating the time periods or distances during which the excess working range is accessed within the most recent unit tune or unit distance.

For example, if a driver starts driving at 00.00, and then accesses the excess range for 1 minute finishing at 00.10, then for 2.5 minutes finishing at 00.30, and finally for 0.5 minutes finishing at 00.50, the cumulative consumed excess value at 00.50 hours will be 1+2.5+0.5=4 min. However, if the driver continues to drive until 01.20 without using the excess range, the new cumulative excess value at 01.20 will only regard the passed time period from 00.20. Accordingly, the cumulative excess value at 01.20 will only be 2.5+0.5=3 min. (The case will be similar if distance is used instead of time.)

Accordingly, only the most recent unit time or unit distance is considered. This option might again be advantageous as it will encourage the driver to save access time to the excess working range.

Preferably, the method could include that, during time periods or distances when access to the excess working range is allowed, exceeding a preset road speed limit is also allowed. In this case, the control using the torque versus engine speed curve is combined with a control of road speed limit as known in the prior art.

Advantageously, the method could include that, during time periods or distances when access to the excess working range is allowed, exceeding a preset acceleration limit is also allowed.

In one alternative, the base torque versus engine speed curve and/or excess torque versus engine speed curve are static. The curves being static mean that they are constant when driving.

In another alternative, the base torque versus engine speed curve and/or excess torque versus engine speed curve are dynamic. The curves being dynamic mean that the may alter or vary throughout the drive.

Preferably, at least one of the base and the excess torque versus engine speed curve is dynamic so as to be determined using the vehicle gross weight as input. In this case, the curve or curves may be adapted to the weight of the vehicle so that a sufficient engine is allowed with consideration to the load.

Preferably, at least one of the base and the excess torque versus engine speed curve is dynamic so as to be determined using the present road profile as input. In this case, the curve or curves may alter when driving so as to meet the demands on the engine caused by the environment, e.g. whether the vehicle is travelling, in a flat or in a hilly landscape. Advantageously, the driver input for requesting access to the excess working range is performed via a dedicated throttle function, preferably of "kick-down" type. This is advantageous since, although the function is convenient as being easy to reach and to control, a "kick-down" function is perceived as somewhat demanding to the driver, so that there is an experience of having to "work" for the excess working range. This contributes to the overall perception that use of the excess working range should be a rare occurrence.

Alternatively, the driver input for requesting access to the excess working range may be performed via a control panel, preferably a button on a control panel.

When using a button, e.g. a push button, this control could be used to give access to the excess working range for a limited time period/distance. This limited time could preferably be set by a timer. Alternatively, access could be allowed for the time during which the driver has an excessive demand, which is indicated by him/her giving full throttle.

Moreover, the two alternatives above may be combined.

Advantageously, the excess availability limit could be temporarily increased following a time period or distance during which a preferred driving pattern was used. Such a driving pattern could be defined as desired, promoting e.g. eco-driving (fuel saving), safe driving etc. Driving patterns could be monitored using numerous in-vehicle systems such as data from the engine and from other systems, from GPS systems etc.

Preferably, such a preferred driving pattern may be defined as driving in a predefined reward area of the base torque versus engine speed curve. For example, the reward area may comprise a combination of high torque with low engine speed, which corresponds to top gear lagging down when driving. Since driving in this area is particularly economic when it comes to fuel consumption, time or distance of driving in this manner could be rewarded by extra excess availability limit, and/or a reduction of the cumulated consumed excess value (used time or distance in excess working range).

Advantageously, an available excess value may be calculated by subtracting the cumulative consumed excess value from the excess availability limit, said available excess value being available to the driver. Accordingly, the driver may be aware of how much time or distance in the excess working range is allowable at each time or distance.

Advantageously, data regarding the time periods or distances during which the excess working range is used may be stored in a memory for use in driving statistics.

In another aspect, in accordance with the invention there is provided an engine control system for controlling an engine to allow a driver to obtain a working range of the engine in excess of a base working range thereof, the system comprising a memory for storing

- the base working range, which limits are defined by a base torque versus engine speed curve,
- the excess working range, which limits are defined between said base torque versus engine speed curve and an excess torque versus engine speed curve, the excess torque versus engine speed curve displaying a higher maximum torque level and/or a higher end engine speed as compared to the base static torque versus engine speed curve,
- an excess availability limit, defining the maximum duration of access to the excess working range per unit time or unit distance; and a processor unit for

- calculating a cumulative consumed excess value per unit time or unit distance by summating any time periods or distances during which the excess working range is accessed within the unit time or unit distance; and controlling the engine in response to driver input to allow access to the excess working range only when the cumulative consumed excess value is less than the excess availability limit.

In yet another aspect, there is provided a computer program comprising program code means for performing all the steps of any one methods as described above when said program is run on a computer.

In yet another aspect, there is provided a computer program product comprising program code means stored on a computer readable medium for performing all steps of anyone of the method as described above when said program product is run on a computer.

In yet another aspect there is provided, a vehicle comprising an engine control system which enables control of the engine in accordance with the method as described above.

BRIEF DESCRIPTION OF THE DRAWINGS

Other objects, features and advantages of the present invention will be apparent from the following detailed description of exemplary embodiments of the invention, with reference to the accompanying drawings, wherein.

Similar reference numbers indicates similar features in the drawings.

DETAILED DESCRIPTION

Figure 1:
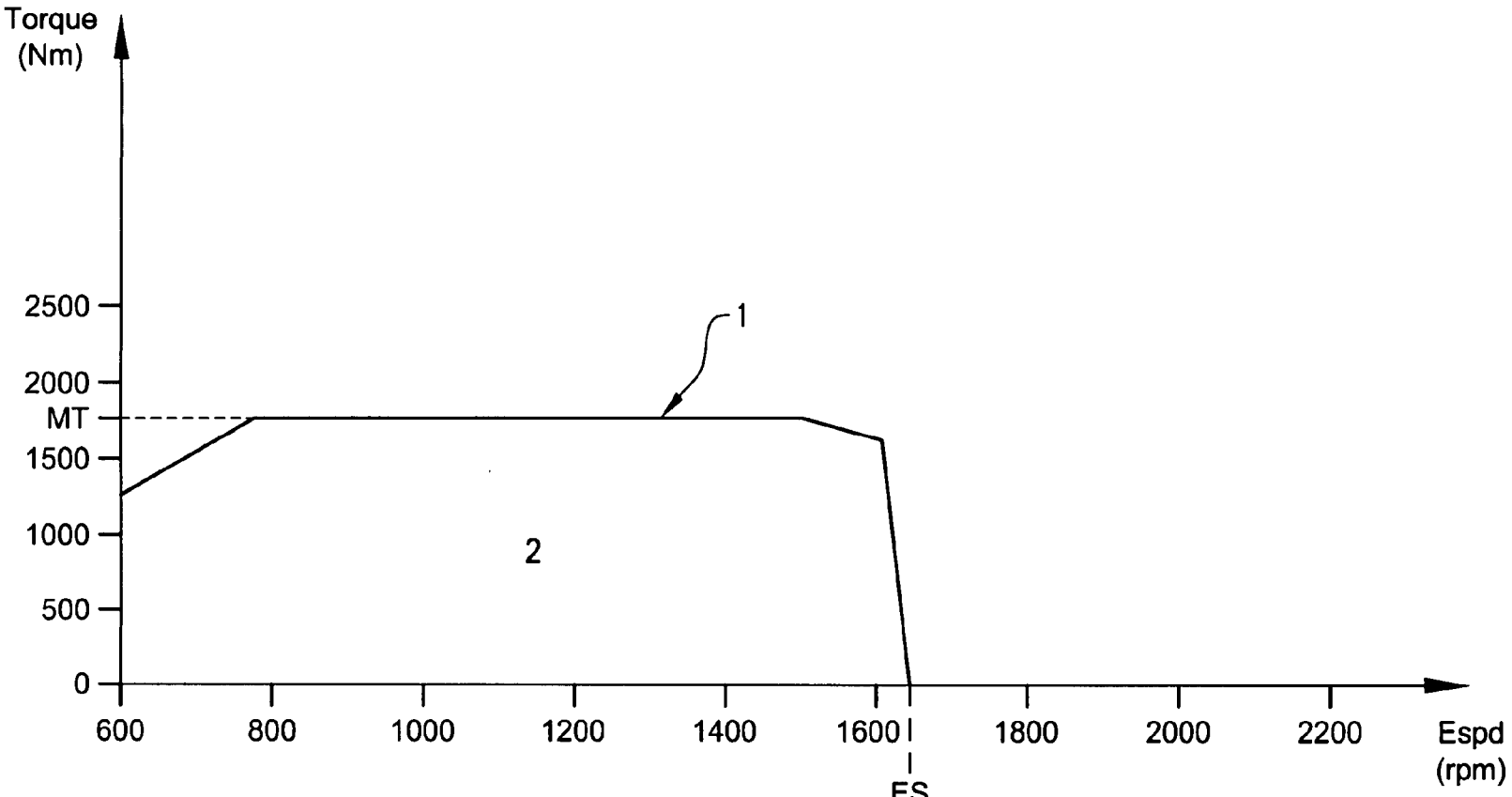
FIG. 1 is a diagram illustrating an example of a base torque versus engine speed curve, defining a base working range.

FIG. 1 is a diagram illustrating an example of a torque versus engine speed curve 1 for an engine of a heavy vehicle. It will be understood that the illustrated curve is an example only and that innumerous variants of torque versus engine speed curves are possible within the frame of this invention.

The torque versus engine speed curve defines a maximum torque level (MT) (about 1750 Nm in FIG. 1). Generally, in the context of heavy vehicle engines, the maximum torque level will be reached at a fairly low engine speed (800 rpm in FIG. 1). At increasing engine speeds, the curve will maintain the maximum torque level (MT) for a relatively broad range (until about 1500 rpm in FIG. 1). Thereafter, the curve will slope downwards until the torque reaches zero. The engine speed at which the torque is zero is referred to at the end engine speed (ES) (just above 1600 rpm in FIG. 1).

The engine may work in a base working range 2 being defined by the area underneath the base torque versus engine speed curve 1 at all times.

The base torque versus engine speed curve may be set to the requirements of a fleet manager or owner. Such setting could be made either fixed from construction, or the curve setting could be rendered available via software equipment in the vehicle so as to allow reselection of the base torque versus engine speed curve during the lifetime of the vehicle. However, the selection of base torque versus engine speed curve should not be rendered accessible to the driver, as this would counteract the purpose of ensuring that economical and/or environmental friendly driving is encouraged.

Figure 2:
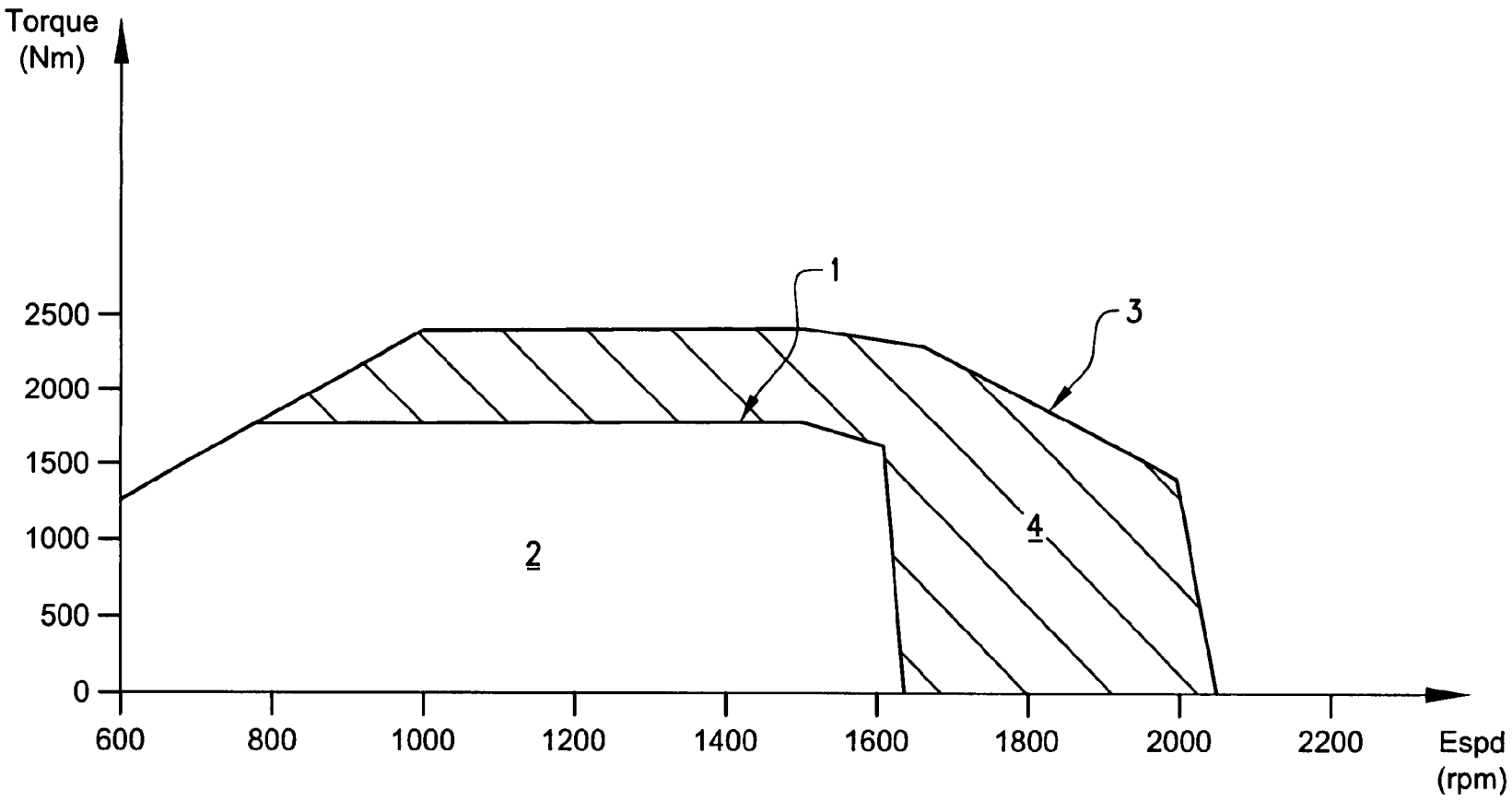
FIG. 2 is a diagram illustrating the base torque versus engine speed curve of FIG. 1, with the addition of an excess torque versus engine speed curve, used for defining an excess working range.

FIG. 2 illustrates a case where an excess torque versus engine speed curve 3 has been established in addition to the base torque versus engine speed curve 1. The excess torque versus engine speed curve 3 displays a higher maximum torque level (about 2500 Nm in FIG. 2) than the base torque versus engine speed curve 1. Moreover, in this case the excess torque versus engine speed curve 3 displays a higher end engine speed (over 2000 rpm in FIG. 2) than the base torque versus engine speed curve 1.

The area between the excess torque versus engine speed curve 3 and the base torque versus engine speed curve 1 defines an excess working range 4. The excess working range 4 is to be rendered available to the driver only during certain circumstances, as will be explained in the below.

Figure 5:
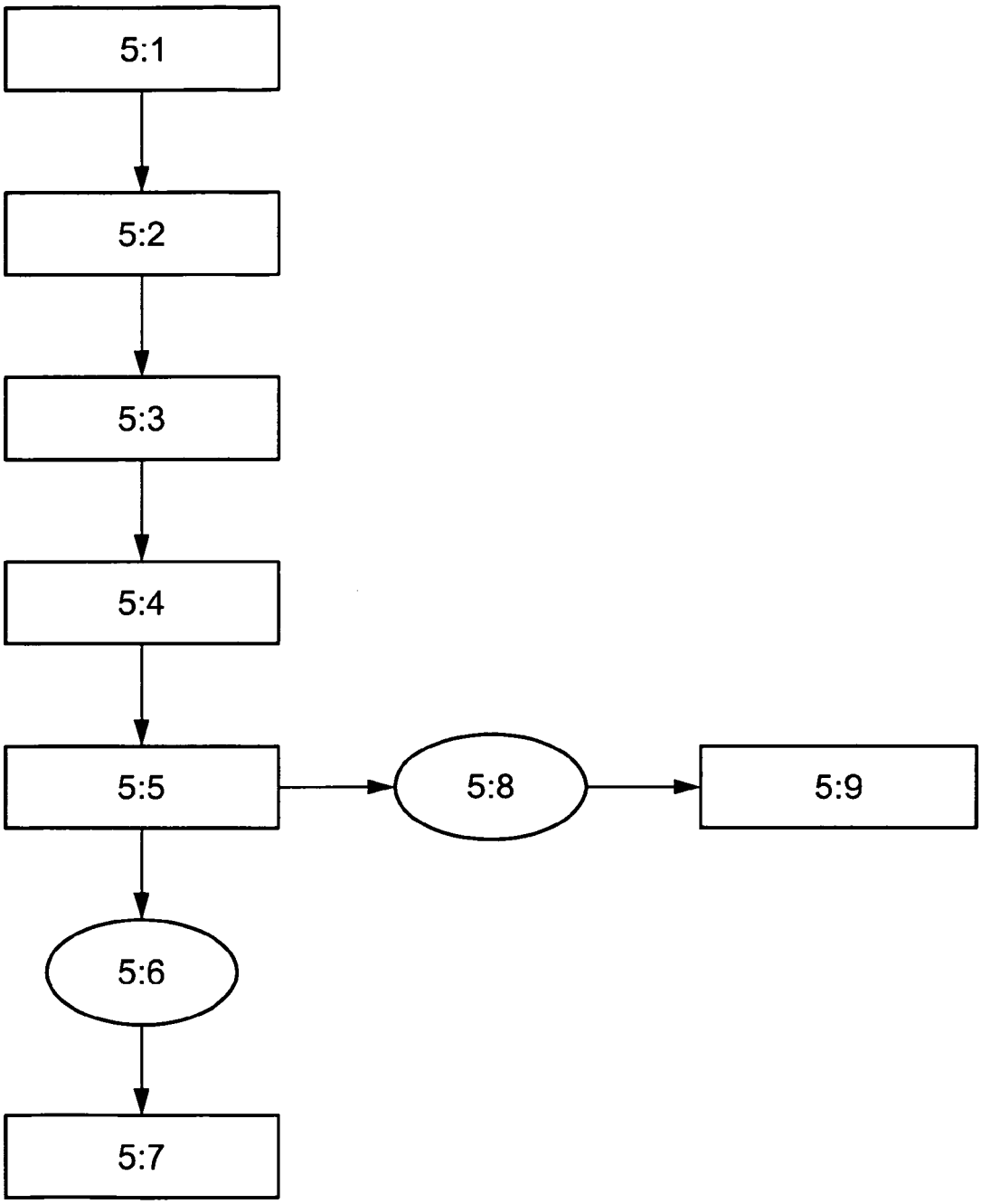
FIG. 5 is a flow chart of an embodiment of a method in accordance with the invention.

FIG. 5 is a flow chart, illustrating an embodiment of a method in accordance with the invention, which uses a pre-established base torque versus engine speed curve 1 and an excess torque versus engine speed curve 3, for example as illustrated in FIG. 2.

The reference numbers in the boxes of FIG. 5 corresponds to text as follows:

5:1—Driver Input
5:2—Request access to excess working range
5:3—Establish excess availability limit
5:4—Calculate cumulative consumed excess value
5:5—Cumulative consumed excess value<excess availability
5:6—YES
5:7—Allow Request
5:8—NO
5:9—Deny Request In 5:1, some type of driver input is necessary to trigger a request 5:2 for access to the excess working range. Naturally, any type of driver input may be used, using any kind of interface with the driver. However, as explained already in the general part, of the application, use of a kick-down throttle pedal is particularly preferred. A kick-down pedal has a stepper close to full throttle. With this type of pedal, it is necessary to press the pedal slightly harder in order to get access to the full throttle, which will correspond to a request.

This is preferred since it gives the driver a perception of having to work for the excess range, which in turn promotes the idea that the excess range is to be used selectively.

However, in an alternative embodiment, some other type of dedicated pedal function may be used. In yet other alternatives, the driver input to request access to the excess working range could be made via a control panel and preferably via a button or the like.

The request for access to the excess working range starts an evaluation process, which is preferably carried out in a processor. In 5:3, an excess availability limit is established, and in 5:4, a cumulative excess value is calculated. The order of these two steps is interchangeable, or alternatively, the steps may be performed simultaneously.

Once the cumulative consumed excess value and the excess availability limit are established, it is controlled, in step 5:5, whether the cumulative consumed excess value is less than the excess availability limit. If yes 5:6, the request is allowed 5:7, if no 5:8, the request is denied 5:9.

The excess availability limit is, as mentioned in the general part of the description, defining the maximum duration (or maximum distance) of access to the excess working range per unit time (or unit distance).

In certain embodiments, the excess availability limit is a constant, preset excess availability limit. For example, the excess availability limit may be 3-10 minutes per hour, preferably 3-8 minutes per hour, most preferred 4-7 minutes per hour. Or, if expressed in distance, the excess availability limit may for example be 5-12 km/100 km, preferably 5-10 km/100 km, most preferred 6-9 km/100 km.

Preferably, the excess availability limit may be expressed as "percent of base unit length", e.g. 2-20% of unit length. With a unit of e.g. 1 hour, the excess availability limit may then be in the range 1-12 minutes per hour. The unit time may advantageously be between 1 and 24 hours, and a unit distance between 50 and 1200 miles (=80 to 2000 km).

The advantage of using a constant excess availability limit is of course that it is simple to use and to control, and that it saves processor resources to use constant values.

However, alternatively the excess availability limit may be a dynamic value, meaning that it may alter during a drive and/or in view of different surroundings or circumstances. The advantage of using a dynamic value is of course that it may be used to control driving behaviour in a more sophisticated manner, and/or to adapt to variations in the surrounding environment.

A particular embodiment of a dynamic excess availability limit is where a "leaky bucket" counter is used as explained in the general part of the description above.

Moreover, the driving behaviour of the driver may be influenced by rewarding preferred driving patterns by temporarily increasing the excess availability limit.

Figure 3:
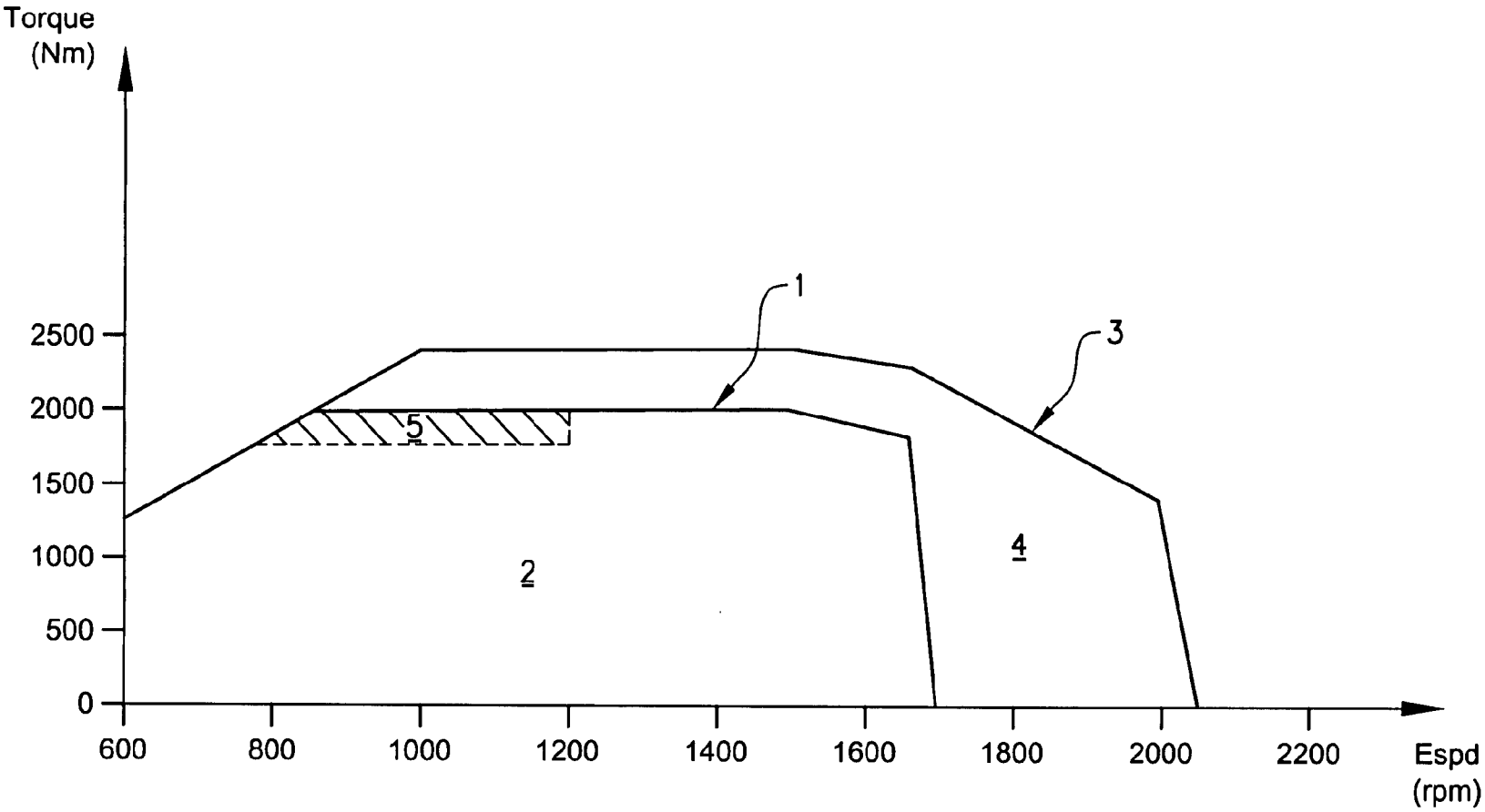
FIG. 3 is a diagram similar to FIG. 2, wherein a reward area is indicated within the base working range.

FIG. 3 illustrates an example where the preferred driving pattern is defined by driving in a preferred area 5 of the base torque versus engine speed curve. In this example, in the preferred area 5, high torque and low engine speed are combined. Driving in this area of the working range is very fuel efficient. Hence, the system may include a function which notes when the driving is performed in the preferred area 5, and increases the excess availability temporarily as a function thereof. For example, one hour of driving in the preferred area 5 could give 5 extra minutes added to the excess availability limit.

However, there should preferably be a maximum excess availability limit which cannot be exceeded.

Advantageously, the system may calculate an available excess value by subtracting the cumulative consumed excess value from the excess availability limit, and display this value to the driver. Hence, the driver gets information of how much excess time/distance remains. Moreover, if combined with a reward system as above, the driver will be encouraged to drive in the reward area when he/she can see the resulting increase of remaining excess time/distance.

Turning now to the cumulative consumed excess value, this value is a sum of the time periods or distances during which the excess working range is accessed within the unit time or unit distance.

The cumulative consumed excess value may be calculated continuously in the processor, such that, when a request for excess working range appears, a current value is readily available.

Alternatively, the cumulative consumed excess value may be calculated only when a request for excess working range is to be processed.

In one embodiment, the cumulative consumed excess value may be set to zero at the start of each unit time or unit distance. The cumulative consumed excess value per unit tune or unit distance is calculated at any time or distance by summating the time periods or distances during which the excess working range is accessed during the unit time or distance.

Figure 6A:
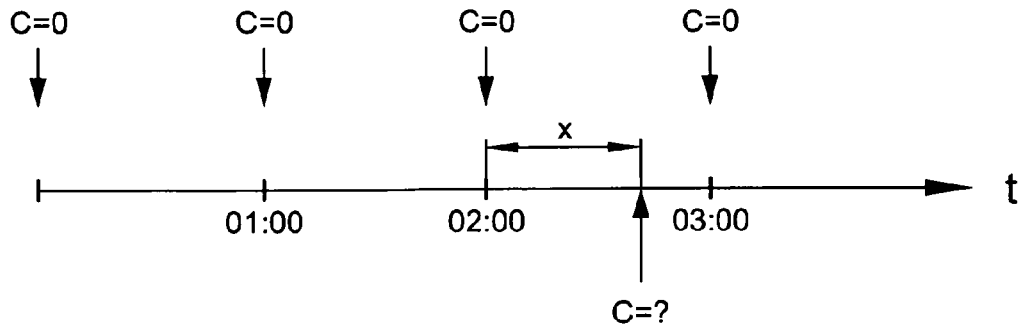
FIGS. 6*a* and *b* illustrate methods for calculating a cumulative consumed excess value.

In FIG. 6*a*, the above embodiment is illustrated, in an example where the unit time is one hour. The cumulative consumed excess value c is set to zero (c=0) at the start of each hour. When the cumulative consumed excess value at a time t, being 02:40 in the example, is to be calculated, only time periods of access to the excess working range occurring within the time range x is to be regarded. As illustrated in FIG. 6*a*, x will extend from the start of the present unit time period (02:00) to the time t (02:40).

In another embodiment, the cumulative consumed excess value per unit time or unit distance may be calculated at any time or distance by summating the time periods or distances during which the excess working range is accessed within the most recent unit time or unit distance.

Figure 6B:
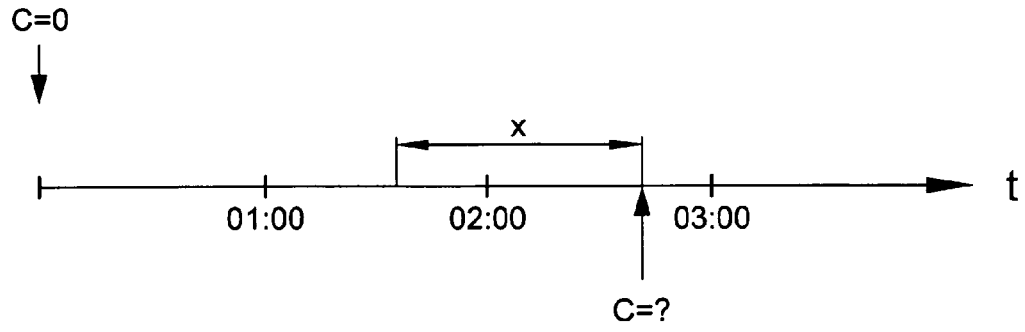

In FIG. 6*b*, this other embodiment is illustrated, in an example where the unit time is one hour. The cumulative consumed excess value is only set to zero (c=0) at the start of the day (or the driving session or the like). When the cumulative consumed excess value at a time t, being 02:40 in the example, is to be calculated, time periods of access to the excess working range occurring within the time range x is to be regarded. As illustrated in FIG. 6*b*, x will extend from the time t (02:40), backwards one unit time (1 hour), to a point in time being the time t minus one unit time (01:40).

Returning now to the torque versus engine speed curves, which are to be established in order to define the base working range and the excess working range.

The torque versus engine speed curves may be static. In this case, the curves are constant and may be loaded e.g. in a memory of the engine control system.

Alternatively, one or both of the torque versus engine speed curves may be dynamic, hence variable. For example, a dynamic torque versus engine speed curve may be determined using the vehicle gross weight and/or a present road profile as input.

Figure 4:
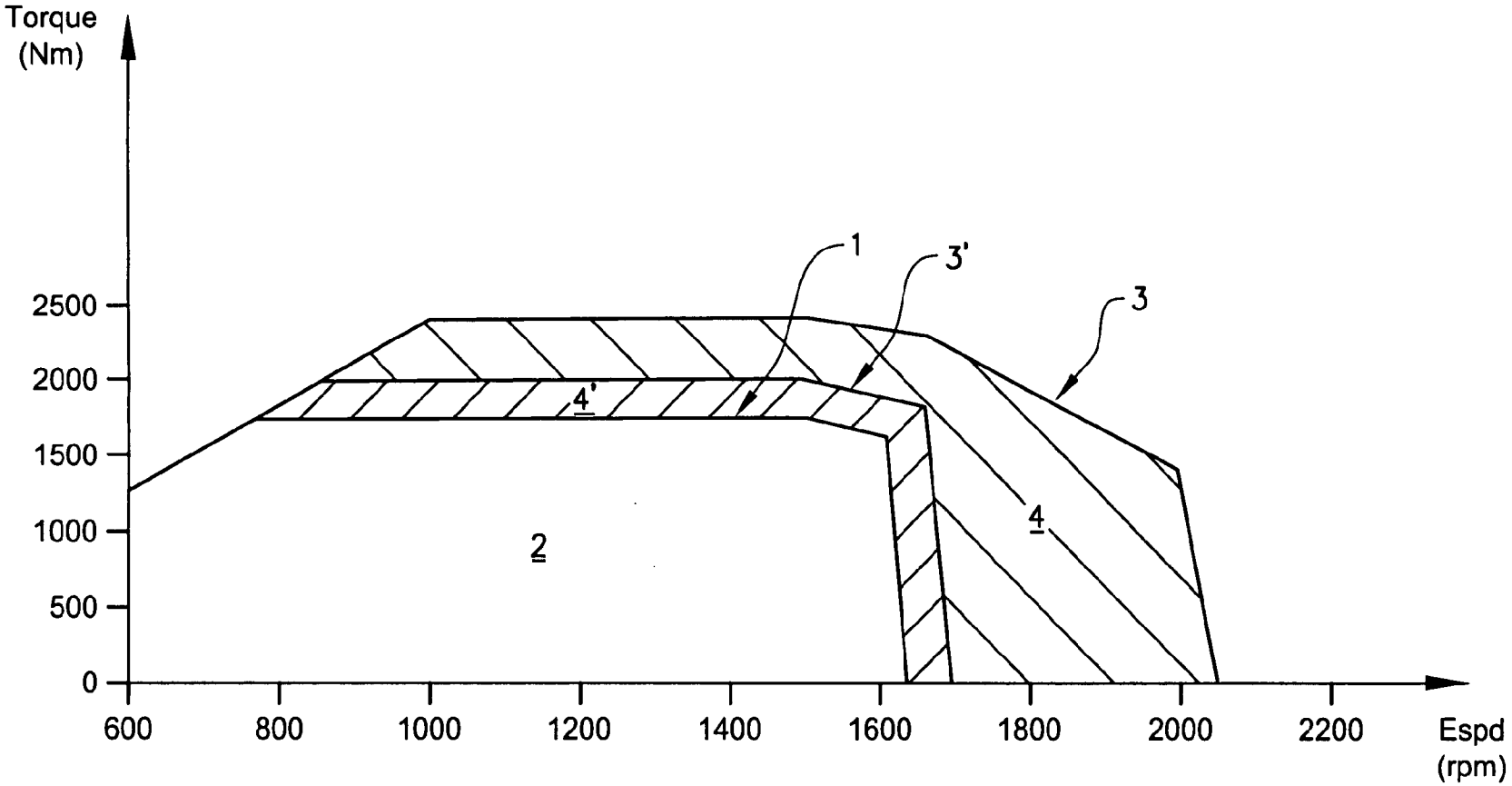
FIG. 4 is a diagram similar to FIG. 2, but illustrating a dynamic excess torque versus engine speed curve.

FIG. 4 illustrates an example where a dynamic excess torque versus engine speed curve is used. As described in relation to FIG. 3, the engine may display a base torque versus engine speed curve 1, defining a base working range 2, and an excess torque versus engine speed curve 3, defining an excess working range 4. In this example, it is assumed that the excess working range 4 is set so as to be sufficient for a fully loaded vehicle, having a relatively high weight to torque/power ratio.

However, when the vehicle is unloaded, and travelling to a new loading station, the weight to torque/power ratio is considerably lower than in its loaded condition. In this case, the weight to torque/power ratio is used as input to select or calculate a new excess torque versus engine speed curve 3' with a corresponding new excess work range 4'. In this case, the new excess torque versus engine speed curve 3', corresponding to a lower vehicle gross weight, will exhibit a lower maximum torque and/or a lower end engine speed than the excess torque versus engine speed 3, corresponding, to a higher weight to torque/power ratio. Accordingly, the excess working range 4' corresponding to the lower weight to torque/power ratio will be smaller than the excess working range 4 corresponding to the higher weight to torque/power ratio.

In some embodiments, the vehicle gross weight may be used instead of the weight to torque/power ratio.

Similarly, adapted excess torque versus engine speed curves may be calculated depending on the present road profile. Generally, hilly surroundings would require "higher" torque versus engine speed curves than flat. In more detail, an uphill slope would result in "higher" torque versus engine speed curve than flat ground or downhill slope.

Although the above example shows the excess curve being dynamic and the base curve being constant, it is to be understood that other combinations are possible—one of both of the base curve and the excess curve may be dynamic.

It will be understood, that although most of the examples above use unit time as a parameter, the examples apply similarly when using distance as a parameter.

Several variants and combinations of the above are possible and may be envisaged by a person skilled in the art.

The invention claimed is:

1. A method for controlling an engine in a vehicle to allOw a driver to obtain a working range of the engine in excess of a base working range thereof, the method comprising establisbing a base working range, which limits are defined by a base torque versus enine speed curve, establishing an excess working range, which limits are defined between the base torque versus engine speed curve and an excess torque versus engine speed curve, the excess torque versus engine speed curve displaying a higher maximum torque level and/or a higher end engine speed as compared to the base torque versus engine speed curve, estiblishing an excess availability limit, defining the maximum duration or maximum distance travelled by the vehicle of access to the excess working range per unit time or unit distance travelled by the vehicle, calculating a cumulative consumed excess value per unit time or unit distance travelled by the vehicle by summating any time periods or distances travelled by the vehicle during which the excess working range is accessed within the unit time or unit distance travelled by the vehicle; and controlling the engine in response to driver input to allow aceess to the excess working range only when the cumulative consumed excess value is less than the excess availability limit, wherein the excess availability limit is temporarily ncreased following a time period or distance travelled by the vehicle during which a preferred driving pattern was used and where the preferred driving pattern is defined by driving in a predefined reward area of the base torque versus engine speed curve.

2. A method according to claim 1, wherein the excess availability limit is a constant, preset maximum excess availability limit.

3. A method according tO claim 1, wherein the excess availability limit is a dynamic value.

4. A method according to claim 1, wherein for each unit time or unit distance, the cumulative consumed excess value is set to zero at the start of the unit time or unit distance, and the cumulative consumed excess value per unit time or unit distance is calculated at any time or distance by summating the time periods or distances during which the excess working range is accessed during the unit time or distance.

5. A method for controlling an engine according to claim 1, wherein the cumulative consumed excess value per unit time or unit distance is calculated at any time or distance by summating the time periods or distances during which the excess working range is accessed within the most recent unit time or unit distance.

6. A method according to claim 1, wherein, when, during time periods or distances when access to the excess working range is allowed, exceeding a present road speed limit, and/or exceeding a present acceleration limit is also allowed.

7. A method according to claim 1, wherein the base torque versus engine speed curve and/or the excess torque versus engine speed curve are static.

8. A method according to claim 1, wherein at least one of the base torque versus engine speed curve and/or the excess torque versus engine speed curve are dynamic.

9. A method according to claim 8, wherein the dynamic torque versus engine speed curve is determined using the vehicle weight to torque/power ratio, the vehicle gross weight and/or a present road profile as input.

10. A method according to claim 1, wherein the driver input for requesting access to the excess working range is performed via a dedicated throttle function.

11. A method according to claim 1, wherein the driver input for requesting access to the excess working range is performed via a control panel.

12. A method according to claim 1, wherein an available excess value is calculated by subtracting the cumulative excess value from the excess availability limit, and wherein the available excess value is available to the driver.

13. A method according to claim 1, wherein data regarding the time periods or distances during which the excess working range is used is stored in a memory for use in driving statistics.

14. An engine control system for controlling an engine in a vehicle to allow a driver to obtain a working range of the engine in excess of a base working range thereof, the system comprising a memory for storing the base working range which limits are defined by a base torque versus engine speed curve, the excess working range, which limits are defined between the base torque versus engine speed curve and an excess torque versus engine speed curve, the excess torque versus engine speed curve displaying a higher maximum torque level and/or a higher end engine speed as compared to the base static torque versus engine speed curve, an excess availability limit, defining the maximum duration of access to the excess working range per unit time or unit distance travelled by the vehicle; and a processor unit for calculating a cumulative consumed excess value per unit time or unit distance travelled by the vehicle by summating any time periods or distances travelled by the vehicle during which the excess working range is accessed within the unit time or unit distance travelled by the vehicle; and controlling the engine in response to driver input to allow access to the excess working range only when the cumulative consumed excess value is less than the excess availability limit and where the excess availability limit is temporatily increased following a time period or distance travelled by the vehicle during which a preferred driving pattern was used and where the preferred driving pattern is defined by driving in a predefined reward area of the base torque versus engine speed curve.

15. A computer comprising a computer program for controlling the engine according to the steps of claim 1.

16. A computer program product comprising a program stored on a non-transitory computer readable medium for controlling the engine according to the steps of claim 1 when the program product is run on a computer.

17. A vehicle comprising an engine control system arranged to control the engine in accordance with the method of claim 1.

* * * * *